US006534426B1

(12) United States Patent
Chiou

(10) Patent No.: US 6,534,426 B1
(45) Date of Patent: Mar. 18, 2003

(54) KNIFE-STAB-RESISTANT COMPOSITE

(75) Inventor: Minshon J. Chiou, Chesterfield, VA (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 09/483,546

(22) Filed: Jan. 14, 2000

(51) Int. Cl.[7] ..... D03D 7/00

(52) U.S. Cl. ..... 442/203; 442/134; 442/135; 442/243; 442/324; 442/326; 442/209; 428/911; 2/2.5

(58) Field of Search ..... 442/134, 135, 442/243, 324, 326, 203, 209; 428/911; 2/2.5

(56) References Cited

U.S. PATENT DOCUMENTS

| | | | | |
|---|---|---|---|---|
| 4,287,607 A | | 9/1981 | Leach | 2/2.5 |
| 4,574,105 A | * | 3/1986 | Donovan | 442/247 |
| 5,073,441 A | | 12/1991 | Melec et al. | 442/1 |
| 5,185,195 A | | 2/1993 | Harpell et al. | 428/102 |
| 5,472,769 A | | 12/1995 | Goerz, Jr. et al. | 428/138 |
| 5,512,348 A | | 4/1996 | Mazelsky | 428/102 |
| 5,578,358 A | | 11/1996 | Foy et al. | 428/104 |
| 5,622,771 A | | 4/1997 | Chiou et al. | 428/219 |
| 5,677,029 A | | 10/1997 | Prevorsek et al. | 428/113 |
| 5,876,834 A | | 3/1999 | Foy et al. | 428/192 |
| 5,880,042 A | | 3/1999 | Schuster et al. | 442/59 |
| 5,903,920 A | | 5/1999 | Granqvist | 2/2.5 |
| 6,162,746 A | * | 12/2000 | Chiou et al. | 442/134 |

FOREIGN PATENT DOCUMENTS

| | | | |
|---|---|---|---|
| EP | 769 671 | 4/1997 | F41H/1/02 |
| GB | 2 304 350 | 3/1997 | F41H/5/04 |
| GB | 2 319 988 A | 6/1998 | |
| JP | 61-275440 | 12/1986 | D03D/1/00 |
| WO | 93/20400 | 10/1993 | F41H/5/04 |
| WO | WO 98/33406 | 8/1998 | |

* cited by examiner

*Primary Examiner*—Terrel Morris
*Assistant Examiner*—John J. Guarriello

(57) ABSTRACT

A layered composite is disclosed having improved resistance to penetration by knives and knife blades. The layers of fabric in the composite are woven with low fabric tightness; and, are arranged in the composite free to move relative to one another.

14 Claims, No Drawings

KNIFE-STAB-RESISTANT COMPOSITE

BACKGROUND OF THE INVENTION

There is a need for protective garments exhibiting improved penetration resistance from knife blades, and more particularly, for garments which are flexible, soft and comfortable to be worn for protection from knife-stab threats such as stiletto, kitchen knife, butterfly knife and boning knife. This invention relates to composites that protect from such penetration, such as by stabs or thrusts from such knives or knife blades.

U.S. Pat. No. 5,622,771, issued Apr. 22, 1997 on the application of Chiou, Foy, and Miner, discloses a penetration resistant article made from tightly woven aramid yarn having a low linear density.

U.S. Pat. No. 5,185,195, issued Feb. 9, 1993 on the application of Harpell et al., discloses a penetration resistant construction wherein adjacent layers of woven aramid or linear polyethylene fabric are affixed together by regular, close, paths. The affixing is preferably by means of stitching.

European Patent Application No. 769,671, published Apr. 23, 1997 discloses an anti-stab material made from woven fabrics using metallic and non-metallic components without disclosed regard for tightness of weave.

SUMMARY OF THE INVENTION

This invention relates to a flexible, matrix-resin-free composite especially resistant to penetration by knife stab comprising a plurality of layers of fabric wherein the areal density of the fabric layers is at least 3.0 kg/m$^2$ and the fabric is made from continuous filament yarns having a tenacity of at least 10 grams per dtex and a tensile modulus of at least 150 grams per dtex woven with a fabric tightness factor of 0.2 to 0.65. The invention also relates to such a penetration resistant composite wherein the layers are joined only at edges of the composite in a manner such that adjacent layers of the fabric are free to move relative to each other.

DETAILED DESCRIPTION

The protective composite of this invention was specially developed to provide protection from penetration by knife blade stabs or thrusts as opposed to protection from ice pick threats. There has been considerable effort expended in the past on improvement of protection from penetration by knife stabs; and the assumption has been that improved stab resistance will be obtained from use of fabrics that are more tightly woven. The inventor herein has found that assumption to be incorrect insofar as knife stabs are concerned. He has discovered that a woven fabric composite with a loose weave, quite surprisingly, exhibits improved resistance to penetration by knife stabs.

The inventor herein has discovered that the knife stab penetration resistance of a fabric composite is dramatically improved when yarns used to make the fabric of the article are woven to a tightness factor of less than 0.65. It is believed that a tightness factor as low as 0.20 will provide improved knife stab resistance. Up to the present invention, penetration resistant fabrics were tightly woven or impregnated by a matrix resin or both. In efforts completely opposite to the current technical understanding, the inventor herein, discovered that matrix-resin-free fabrics with a low fabric tightness factor exhibit improved knife stab penetration resistance. While any fabrics with any reduced tightness factor are expected to exhibit some improvement, the most improvement is found at a tightness factor of less than 0.65. As the tightness factor is further reduced, knife stab resistance is further improved until the tightness factor reaches about 0.20, where the fabric weave is so loose that an unacceptably high areal density would be required for effective protection.

Ballistic garments are generally made using several layers of protective fabric and the several layers are nearly always fastened together in a way to hold faces of the adjacent layers in fixed position relative to each other. It has been found that knife stab penetration resistance is improved if adjacent layers in a protective composite are not held together; but are free to move relative to each other. When adjacent layers are stitched closely together, knife stab penetration resistance is decreased.

The invention herein is constructed entirely of woven fabric without rigid plates or platelets and without matrix resins impregnating the fabric materials. The articles of this invention are more flexible, lighter in weight, softer to the touch, more comfortable to be worn, and more pliable than penetration resistant constructions of the prior art offering comparable knife-stab protection.

Fabrics of the present invention are made, in whole or in part, from yarns having a tenacity of at least 10 grams per dtex and a tensile modulus of at least 150 grams per dtex. Such yarns can be made from aramids, polyolefins, polybenzoxazole, polybenzothiazole, and the like; and, if desired, the fabrics can be made from mixtures of such yarns.

By "aramid" is meant a polyamide wherein at least 85% of the amide (—CO—NH—) linkages are attached directly to two aromatic rings. Suitable aramid fibers are described in Man-Made Fibers—Science and Technology, Volume 2, Section titled Fiber-Forming Aromatic Polyamides, page 297, W. Black et al., Interscience Publishers, 1968. Aramid fibers are, also, disclosed in U.S. Pat. Nos. 4,172,938; 3,869,429; 3,819,587; 3,673,143; 3,354,127; and 3,094,511.

Additives can be used with the aramid and it has been found that up to as much as 10 percent, by weight, of other polymeric material can be blended with the aramid or that copolymers can be used having as much as 10 percent of other diamine substituted for the diamine of the aramid or as much as 10 percent of other diacid chloride substituted for the diacid chloride of the aramid.

Para-aramids are the primary polymers in aramid yarn fibers of this invention and poly(p-phenylene terephthalamide) (PPD-T) is the preferred para-aramid. By PPD-T is meant the homopolymer resulting from mole-for-mole polymerization of p-phenylene diamine and terephthaloyl chloride and, also, copolymers resulting from incorporation of small amounts of other diamines with the p-phenylene diamine and of small amounts of other diacid chlorides with the terephthaloyl chloride. As a general rule, other diamines and other diacid chlorides can be used in amounts up to as much as about 10 mole percent of the p-phenylene diamine or the terephthaloyl chloride, or perhaps slightly higher, provided only that the other diamines and diacid chlorides have no reactive groups which interfere with the polymerization reaction. PPD-T, also, means copolymers resulting from incorporation of other aromatic diamines and other aromatic diacid chlorides such as, for example, 2,6-naphthaloyl chloride or chloro- or dichloroterephthaloyl chloride or 3,4'-diaminodiphenylether. Preparation of PPD-T is described in U.S. Pat. Nos. 3,869,429; 4,308,374; and 4,698,414.

By "polyolefin" is meant polyethylene or polypropylene. By polyethylene is meant a predominantly linear polyethylene material of preferably more than one million molecular weight that may contain minor amounts of chain branching or comonomers not exceeding 5 modifying units per 100 main chain carbon atoms, and that may also contain admixed therewith not more than about 50 weight percent of one or more polymeric additives such as alkene-1-polymers, in particular low density polyethylene, propylene, and the like, or low molecular weight additives such as anti-oxidants, lubricants, ultra-violet screening agents, colorants and the like which are commonly incorporated. Such is commonly known as extended chain polyethylene (ECPE). Similarly, polypropylene is a predominantly linear polypropylene material of preferably more than one million molecular weight. High molecular weight linear polyolefin fibers are commercially available. Preparation of polyolefin fibers is discussed in U.S. Pat. No. 4,457,985.

Polybenzoxazole and polybenzothiazole are preferably made up of mers of the following structures:

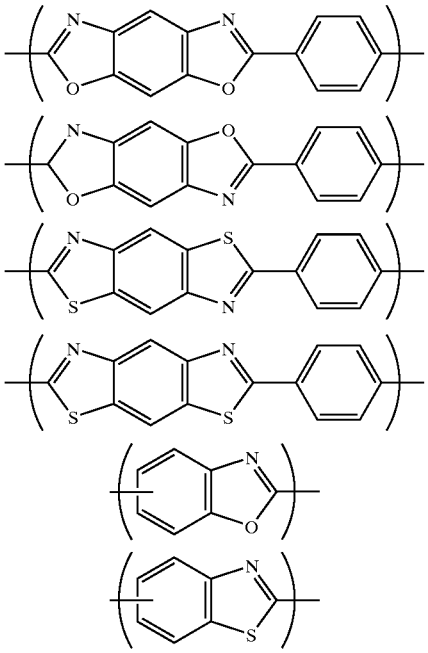

While the aromatic groups shown joined to the nitrogen atoms may be heterocyclic, they are preferably carbocyclic; and while they may be fused or unfused polycyclic systems, they are preferably single six-membered rings. While the group shown in the main chain of the bis-azoles is the preferred para-phenylene group, that group may be replaced by any divalent organic group which doesn't interfere with preparation of the polymer, or no group at all. For example, that group may be aliphatic up to twelve carbon atoms, tolylene, biphenylene, bis-phenylene ether, and the like.

The polybenzoxazole and polybenzothiazole used to make fibers of this invention should have at least 25 and preferably at least 100 mer units. Preparation of the polymers and spinning of those polymers is disclosed in the aforementioned International Publication WO 93/20400.

"Fabric tightness factor" and "Cover factor" are names given to the density of the weave of a fabric. Cover factor is a calculated value relating to the geometry of the weave and indicating the percentage of the gross surface area of a fabric that is covered by yarns of the fabric. The equation used to calculate cover factor is as follows (from Weaving: Conversion of Yarns to Fabric, Lord and Mohamed, published by Merrow (1982), pages 141–143):

$d_w$=width of warp yarn in the fabric
$d_f$=width of fill yarn in the fabric
$p_w$=pitch of warp yarns (ends per unit length)
$p_f$=pitch of fill yarns $$C_w = \frac{d_w}{pw} \quad C_f = \frac{d_f}{pf}$$

$$Fabric\ Cover\ Factor = C_{fab} = \frac{total\ area\ obscured}{area\ enclosed}$$

$$C_{fab} = \frac{(p_w - d_w)\,d_f + d_w p_f}{p_w p_f} = (C_f + C_w - C_f C_w)$$

Depending on the kind of weave of a fabric, the maximum cover factor may be quite low even though the yarns of the fabric are situated close together. For that reason, a more useful indicator of weave tightness is called the "fabric tightness factor". The fabric tightness factor is a measure of the tightness of a fabric weave compared with the maximum weave tightness as a function of the cover factor.

$$\text{Fabric tightness factor} = \frac{\text{actual cover factor}}{\text{maximum cover factor}}$$

For example, the maximum cover factor that is possible for a plain weave fabric is 0.75; and a plain weave fabric with an actual cover factor of 0.49 will, therefore, have a fabric tightness factor of 0.65. Different fabric weaves, such as plain, twill or satin weaves and their variants, can be used as the fabric for this invention. The preferred weave for practice of this invention are twill and satin weaves and their variants, including crowfoot weave—sometimes known as 4-harness satin weave, since they are more flexible and pliable than the plain weave and can better conform to complex curves and surfaces.

While the reason for the improved knife stab protection of this invention is not well understood, it is believed to relate to absorption of energy from a knife blade as yarns in a loosely-woven fabric are moved but not cut by contact with a stabbing blade.

The yarns used in this invention must have a high tenacity of at least 10 grams per dtex (11.1 grams per denier) and there is no known upper limit for tenacity. Below a tenacity of about 5 grams per dtex, the yarn doesn't exhibit adequate strength for meaningful protection. The yarns must have a tensile modulus of at least 150 g/dtex because too low a modulus will result in excessive fiber stretching and ineffective restriction of the movement of the stabbing knife. There is no known upper limit for tensile modulus.

A single layer of the woven article of this invention would provide a measure of knife stab penetration resistance and, therefore, a degree of protection; but a plurality of layers are required in an ultimate product. It is in the use of a plurality of low tightness factor fabric layers with a total areal density of at least 3.0 kg/m$^2$ that the present invention exhibits its most pronounced and surprising improvement. It has been discovered that articles of this invention, when placed together in a plurality of layers, afford a surprisingly effective penetration resistance when the articles are not affixed to one another, thereby permitting relative movement between adjacent layers. The construction of protective structure of this invention may also include a plurality of the aforementioned woven fabric and a felt material, generally made from aramid staple fibers. The felt is of a density from 200 to 4000 grams per square meter, preferably from 500 to 1000 grams per square meter. Adjacent layers or articles may be fastened at the edges or there may be some loose interlayer connections at relatively great spacings compared with the thickness of the articles. For instance, layer-to-layer attachments at point spacings of greater than about 15 centimeters would serve, for this application, as being substantially free from means for holding the layers together. Layers which have been stitched together over the surface of the layers may provide more effective ballistics protection; but such stitching causes immobility between the layers and, for reasons not entirely understood, actually decreases the knife stab penetration resistance of the layers as compared with expectations based on single layer tests.

While various standards have been developed and used globally, in general, standards for knife stab protection mandate a knife stab penetration resistance of greater than 20 joules. The composite of the present invention performs at that level when the areal density of the composite is more than about 6.0 kg/m$^2$. Also, at that areal density, and, as a result of the low tightness factor, the composite is flexible and breathable and can conform to the shape of the body for comfort as an effective protective garment component. Knife stab protection is, of course, improved as the areal density of the composite is increased; but the inventor estimates that little practical benefit is achieved at areal densities above about 15 kg/m$^2$ due to the increased bulkiness and reduced comfort of the protective garment.

TEST METHODS

Linear Density. The linear density of a yarn or a filament is determined by weighing a known length of the yarn or filament. "Dtex" is defined as the weight, in grams, of 10,000 meters of the material. "Denier" is the weight, in grams, of 9000 meters of the material.

In actual practice, the measured dtex of a yarn or filament sample, test conditions, and sample identification are fed into a computer before the start of a test; the computer records the load-elongation curve of the sample as it is broken and then calculates the properties.

Tensile Properties. Yarns tested for tensile properties are, first, conditioned and, then, twisted to a twist multiplier of 1.1. The twist multiplier (TM) of a yarn is defined as:

$$TM=(\text{twists/cm})(\text{dtex})^{-1/2}/30.3=(\text{twists/inch})(\text{denier})^{-1/2}/73$$

The yarns to be tested are conditioned at 25° C., 55% relative humidity for a minimum of 14 hours and the tensile tests are conducted at those conditions. Tenacity (breaking tenacity), elongation to break, and tensile modulus are determined by breaking test yarns on an Instron tester (Instron Engineering Corp., Canton, Mass.).

Tenacity, elongation, and tensile modulus, as defined in ASTM D2101-1985, are determined using yarn gage lengths of 25.4 cm and an elongation rate of 50% strain/minute. The modulus is calculated from the slope of the stress-strain curve at 1% strain and is equal to the stress in grams at 1% strain (absolute) times 100, divided by the test yarn linear density.

Tenacity, elongation, and tensile modulus of individual filaments are determined in the same way as for yarns; but filaments are not subjected to twist and a gage length of 2.54 cm is used.

Penetration Resistance. Knife stab penetration resistance is determined on a plurality of layers of the fabrics using a PSDB P1 single-edge blade with a Rockwell hardness of 52-55 and with a total length of 10 cm and thickness of 2 mm as specified in the "PSDB Stab Resistance Standard for Body Armor", issued in 1999 by the Police Scientific Development Branch of the United Kingdom. Tests are conducted in accordance with HPW drop test TP-0400.03 (Nov. 28, 1994) from H. P. White Lab., Inc., except that PSDB P1 blades are used, and a composite material of four layers of 6 mm neoprene, one layer of 30 mm Plastazote foam, and two layers of 6 mm rubber was used as the backing material, in accordance with the aforementioned PSDB Stab Resistance Standard. Test samples, placed on the backing material, are impacted with the PSDB P1 knife that has been weighted to 4.54 kilograms (10 pounds) and dropped from various heights until penetration of the sample under test is accomplished. Results are reported as penetration energy (joules) by multiplying kilogram-meters, from the energy at the penetrating height, by 9.81.

EXAMPLES

In the following examples, composites of a plurality of fabric layers were tested for knife-stab penetration. Several different fabrics with different tightness factors made from yarns of para-aramid fibers sold by E. I. du Pont de Nemours and Company under the tradename of Kevlar®, were tested at areal densities that were, generally, 6 to 7 kg/m$^2$. The para-aramid yarns of these examples were poly(p-phenylene terephthalamide) and had a tenacity of greater than 20 grams per dtex and a tensile modulus of greater than 500 grams per dtex. An example with high density felt made from Kevlar® staple with an areal density of 0.8 kg/m$^2$ was also included.

TABLE 1

| Example No. | Composite Construction | Tightness Factor |
|---|---|---|
| 1 | 36 layers, 1266 dtex yarn<br>Crowfoot weave, 7 × 7 ends/cm | 0.56 |
| 2 | 56 layers, 1266 dtex yarn<br>Crowfoot weave, 7 × 7 ends/cm | 0.56 |
| 3 | 36 layers, 1266 dtex yarn<br>Crowfoot weave, 7 × 7 ends/cm<br>1 layer high density aramid felt | 0.56 |
| 4 | 36 layers, 1266 dtex yarn<br>Plain weave, 7 × 7 ends/cm | 0.65 |
| Comparative 1 | 50 layers, 222 dtex yarn<br>Plain weave, 28 × 28 ends/cm | 0.99 |
| Comparative 2 | 37 layers, 666 dtex yarn<br>Plain weave, 12 × 12 ends/cm | 0.82 |
| Comparative 3 | 30 layers, 933 dtex yarn<br>Plain weave, 12 × 12 ends/cm | 0.93 |
| Comparative 4 | 24 layers, 1111 dtex yarn<br>Plain weave, 12 × 12 ends/cm | 0.97 |
| Comparative 5 | 24 layers, 1577 dtex yarn<br>Plain weave, 8 × 8 ends/cm | 0.82 |

The felt, when tested by itself, showed little knife-stab resistance. However, when the felt was used as a part of the protective structure against the body side, it did show an added enhancement in the knife-stab resistance for the overall composite.

Results of the tests are shown in Table II.

TABLE II

| Example No. | Areal Density (kg/m$^2$) | Tightness Factor | Knife-Stab Penetration Resistance (joules) |
|---|---|---|---|
| 1 | 6.3 | 0.56 | 27 |
| 2 | 9.8 | 0.56 | Greater than 50 |
| 3 | 7.1 | 0.56 | Greater than 50 |
| 4 | 6.3 | 0.65 | 20 |

TABLE II-continued

| Example No. | Areal Density ($kg/m^2$) | Tightness Factor | Knife-Stab Penetration Resistance (joules) |
|---|---|---|---|
| Comparative 1 | 6.2 | 0.99 | 8 |
| Comparative 2 | 5.9 | 0.82 | 8 |
| Comparative 3 | 6.8 | 0.93 | 8 |
| Comparative 4 | 6.4 | 0.97 | 7 |
| Comparative 5 | 6.4 | 0.82 | 6 |

What is claimed is:

1. A flexible matrix-resin-free composite especially resistant to penetration by knife stab comprising a plurality of layers of fabric wherein the areal density of the fabric layers is at least 3 $kg/m^2$ and the fabric is made from continuous filament yarns having a tenacity of at least 10 grams per dtex and a tensile modulus of at least 150 grams per dtex woven with a fabric tightness factor of 0.2 to 0.65.

2. The composite of claim 1 wherein adjacent layers of the fabric are free to move relative to each other.

3. The composite of claim 1 wherein the areal density of the fabric layers is 3 to 15 $kg/m^2$.

4. The composite of claim 1 wherein there is included at least one layer of aramid felt.

5. The composite of claim 4 wherein the felt is made from aramid staple fibers.

6. The composite of claim 1 wherein the yarns are aramid yarns.

7. The composite of claim 1 wherein the yarns are polyolefin yarns.

8. The composite of claim 1 wherein the yarns are polybenzoxazole or polybenzothiazole yarns.

9. The composite of claim 6 wherein the aramid yarns are poly(para-phenylene terephthalamide) yarns.

10. The composite of claim 1 wherein the woven fabric is a crowfoot weave.

11. The composite of claim 1 wherein the woven fabric is a plain weave.

12. The composite of claim 1 wherein the yarn has a linear density of 0.5 to 8 dtex.

13. The composite of claim 1 having a stab resistance of greater than 20 joules.

14. The composite of claim 4 having a stab resistance of greater than 20 joules.

* * * * *